US005581831A

United States Patent [19]

Xiang

[11] Patent Number: 5,581,831

[45] Date of Patent: Dec. 10, 1996

[54] ERGONOMIC PILLOW

[76] Inventor: Kun Xiang, 110 Pacific Ave., #239, San Francisco, Calif. 94111

[21] Appl. No.: 567,312

[22] Filed: Dec. 5, 1995

Related U.S. Application Data

[63] Continuation-in-part of Ser. No. 158,465, Nov. 29, 1993, abandoned.

[51] Int. Cl.[6] ..... A47G 9/02

[52] U.S. Cl. ..... 5/636; 5/633

[58] Field of Search ..... 5/633, 636, 639, 5/640, 643

[56] References Cited

U.S. PATENT DOCUMENTS

| | | | |
|---|---|---|---|
| 1,701,129 | 2/1929 | Safford | 5/636 |
| 2,700,779 | 2/1955 | Tolkowsky | 5/636 X |
| 3,003,815 | 10/1961 | Zinn | 5/633 X |
| 3,648,308 | 3/1972 | Greenawalt | 5/633 X |
| 4,918,774 | 4/1990 | Popitz | 5/636 X |

*Primary Examiner*—Michael F. Trettel

*Attorney, Agent, or Firm*—Jack Lo

[57] ABSTRACT

An ergonomic pillow includes a body having a top with upper, middle, and lower stepped portions descending from the rear to the front thereof, and a transverse, elongated support member arranged between the upper and middle stepped portions. The pillow is usable for supporting a supine person for sleeping, so that the head is supported on the upper stepped portion, the neck is supported on the elongated support member, the shoulders are supported on the middle and lower stepped portions. Thus the head is tilted back slightly relative to the back, so as to promote shortening and relaxation of the muscles on the back of the neck and shoulders. The pillow is also usable for supporting a person sleeping sideways, so that a shoulder is supported on the middle and lower stepped portions, and the head is supported on the elongated support member in a comfortable, natural position. The pillow is also usable for supporting a supine person, so that the lower back or occipital portion of the skull and part of the neck are supported on the elongated support member, and the shoulders are supported by the middle and lower stepped portions, so that the head is tilted upwardly enough for watching television or reading in bed, on the floor, on a sofa, etc.

8 Claims, 2 Drawing Sheets

ERGONOMIC PILLOW

BACKGROUND OF THE INVENTION

1. Cross Reference To Related Application

This is a continuation-in-part of application number 08/158,465, filed Nov. 29,1993, now abandoned.

2. Field of the Invention

This invention relates generally to pillows, specifically to an ergonomic pillow.

3. Prior Art A conventional flat pillow does not provide proper support for a person's head and neck. It tends to bend the head and neck upwardly, and cause the muscles on the back of the neck to lengthen and gradually become fatigued. A flat pillow is also unsuitable for supporting a person in a position for reading or watching television in bed or on the floor, unless it is propped up against the headboard of the bed, which is inconvenient and ergonomically improper.

Several special pillows have been offered for solving some of these problems. U.S. Pat. No. 4,550,459 to Endel et al. (1985) and U.S. Pat. No. 4,956,886 to Sarkozi (1990) each discloses a pillow with a Large lower portion, and a smaller upper portion slightly spaced from the front of the lower portion. In use, the head of a user lying supine or face up is supported by the back of the lower portion, the neck is supported by the upper portion, and the shoulders are supported by the front of the lower portion. However, the upper portion supports the neck too high when the person is lying sideways, so that the head is tilted downwardly in an uncomfortable and unnatural position. U.S. Pat. No. 4,949,411 to Tesch (1990) discloses a flat pillow with different regions of firmness for supporting the head and neck, but includes no provision for supporting the shoulders at all.

OBJECTS OF THE INVENTION

Accordingly the primary object of the present invention is to provide an ergonomic pillow that supports a supine person's head, neck, and shoulders in a position that promotes shortening and relaxation of the muscles on the back of the neck and shoulders.

Another object of the present invention is to provide an ergonomic pillow that supports the head and a shoulder of a person lying sideways, so that the head is supported in a comfortable, natural position.

Yet another object of the present invention is to provide an ergonomic pillow that comfortably supports the head, neck, and shoulders of a person in a position suitable for watching television or reading in bed, on the floor, on a sofa, etc.

Further objects of the present invention will become apparent from a consideration of the drawings and ensuing description.

SUMMARY OF THE INVENTION

An ergonomic pillow includes a generally wedge-shaped body having upper, middle, and lower stepped portions, and an elongated supporting member arranged between the upper and middle stepped portions.

Drawing Reference Numerals

| | |
|---|---|
| 10. Pillow Body | 11. Front |
| 12. Back | 13. Sides |
| 14. Top | 15. Bottom |
| 16. Upper Stepped Portion | 17. Middle Stepped Portion |
| 18. Lower Stepped Portion | 19. Elongated Support Member |
| 20. Head | 21. Neck |
| 22. Shoulder | |

DESCRIPTION—FIG. 1

Figure 1:
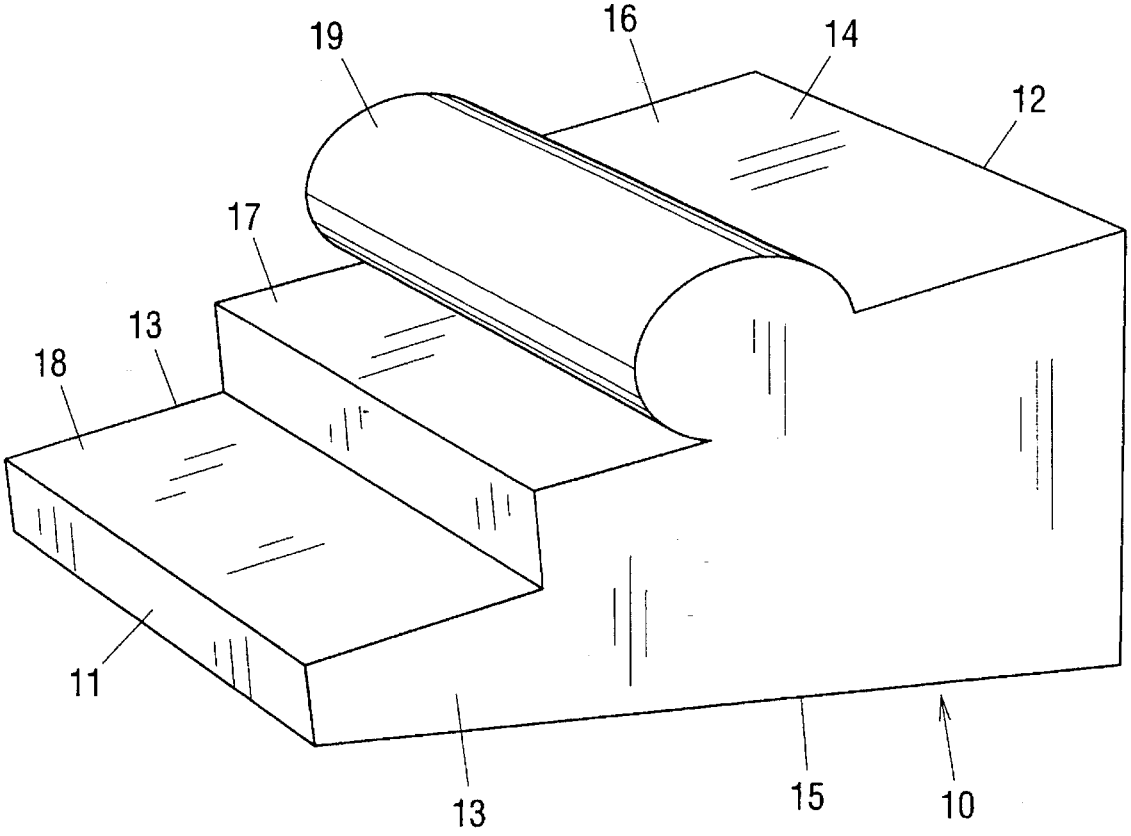
FIG. 1 is a side perspective view of an ergonomic pillow in accordance with a preferred embodiment of the invention.

In accordance with a preferred embodiment of the invention shown in the side perspective view of FIG. 1, an ergonomic pillow includes a generally wedge-shaped body 10 with a thin front 11, a substantially thicker rear 12, opposite sides 13, a top 14, and a bottom 15. Top 14 includes upper, middle, and lower stepped portions 16, 17, and 18, respectively, that descend from rear to front. Each stepped portion is flat, and angled slightly downwardly toward front 11. A transverse, elongated cylindrical support member 19 is arranged between upper and middle stepped portions 16 and 17, respectively.

In this example, the pillow is made of foam, and is about 5.1 cm high at front 11, 24.1 cm high at rear 12, 51 cm deep between front 11 and rear 12, and 56 cm wide between sides 13. Elongated support member 19 projects about 10 cm above upper stepped portion 16.

DESCRIPTION—FIG. 2

Figure 2:
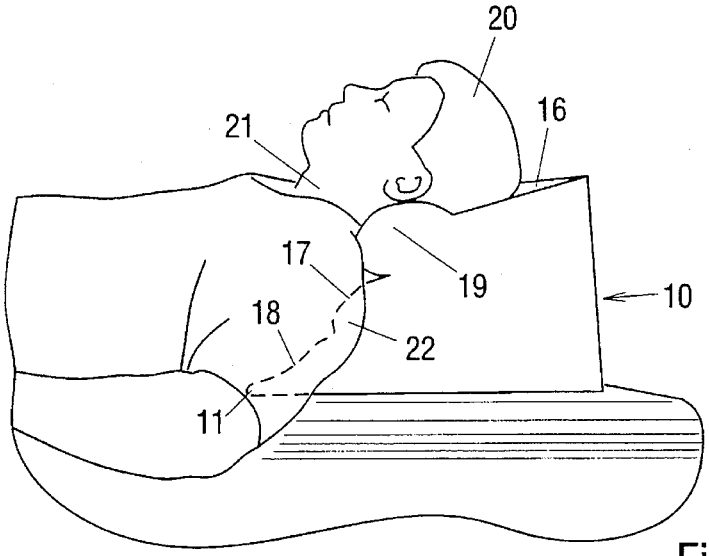
FIG. 2 is a side perspective view of the ergonomic pillow supporting a sleeping person lying in a supine position.

The ergonomic pillow is shown supporting a person sleeping in a supine position in FIG. 2. The person is positioned so that the head 20 is supported by upper stepped portion 16, the neck 21 is supported by elongated member 19, and the shoulders 22 are supported by middle and lower stepped portions 17 and 18, respectively. Elongated support member 19 causes head 20 to be tilted back slightly relative to shoulders 22, so as to promote shortening and relaxation of the muscles on the back of the neck and shoulders.

DESCRIPTION—FIG. 3

Figure 3:
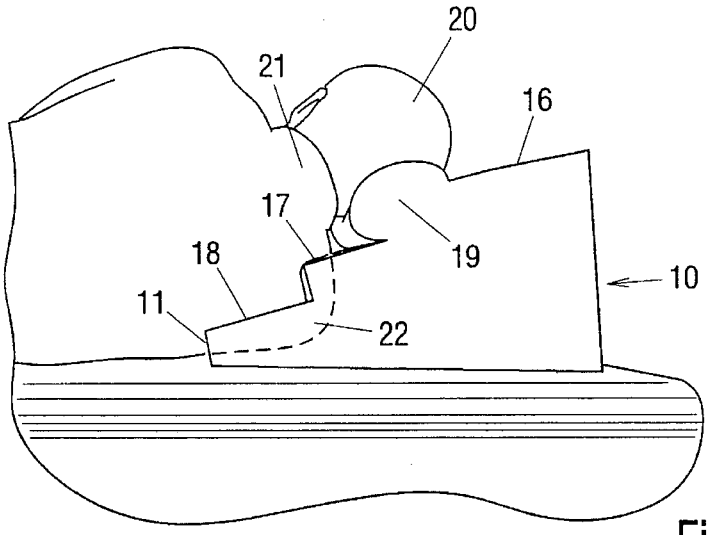
FIG. 3 is a side perspective view of the ergonomic pillow supporting a sleeping person lying sideways.

The ergonomic pillow is shown supporting a person sleeping sideways in FIG. 3. The person is positioned so that head 20 is supported by elongated support member 19, and a shoulder 22 is supported by middle and lower stepped portions 17 and 18, respectively, which are substantially compressed under shoulder 22. The top of elongated support member 19 is spaced from the top of lower stepped portion 18 about the width of shoulder 22, so that head 20 is supported in a comfortable, natural position.

DESCRIPTION—FIG. 4

Figure 4:
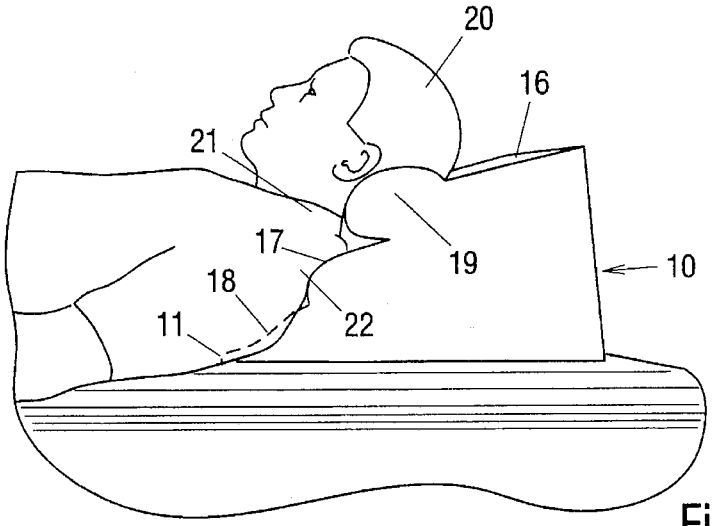
FIG. 4 is a side perspective view of the ergonomic pillow supporting a person in a supine position suitable for watching television or reading in bed, on the floor, on a sofa, etc.

The ergonomic pillow is shown supporting a person lying in another supine position in FIG. 4. The person is positioned so that the lower back or occipital portion of the skull or head 20 is supported by the top of elongated support member 19, the top and the middle of neck 21 are partially supported by elongated support member 19, and shoulders 22 are supported by middle and lower stepped portions 17 and 18, respectively. Head 20 is thus tilted upwardly enough for watching television or reading in bed, on the floor, on a sofa, etc.

SUMMARY, RAMIFICATIONS AND SCOPE

Accordingly, I have provided an ergonomic pillow that is usable for supporting a supine person's head, neck, and shoulders in a position that promotes shortening and relaxation of the muscles on the back of the neck and shoulders. It is usable for supporting the head in a comfortable, natural position when the person is lying sideways. It is also usable for supporting the head of a supine person in an upright enough position for watching television or reading in bed, on the floor, on a sofa, etc.

Although the above descriptions are specific, they should not be considered as limitations on the scope of the invention, but only as examples of the embodiments. Many other ramifications and variations are possible within the teachings of the invention. For example, the dimensions of the pillow may be changed for supporting people of different sizes. The top and middle stepped portions may be arranged on the same level, so that the pillow has only top and lower stepped o portions. A form-fitting fabric case may be provided to enclose and protect the pillow. Instead of foam, the pillow may be constructed of other suitable materials or in other ways, such as a fabric shell stuffed with cotton, beads, or other fillers. Therefore, the scope of the invention should be determined by the appended claims and their legal equivalents, not by the examples given.

I claim:

1. A pillow, comprising:

a body having a front, a rear, opposite sides, a top, and a bottom; and an elongated support member arranged transversely on said top between said sides;

said body including a stepped portion arranged on said top forward of said elongated support member;

whereby said pillow is positionable under a supine person, so that a head thereof is supported by a portion of said top between said elongated support member and said rear, a neck thereof is supported by said elongated support member, and a pair of shoulders thereof is supported by said stepped portion; said pillow is also positionable under said person when said person is lying sideways, so that said head is supported by said elongated support member, and one of said shoulders is supported by said stepped portion.

2. The pillow of claim 1 wherein said rear is substantially thicker than said front.

3. The pillow of claim 1 wherein said stepped portion is sloped downwardly toward said front.

4. The pillow of claim 1 wherein a top of said elongated support member is spaced from a top of said stepped portion a distance generally equal to a width of one of said shoulders.

5. A pillow, comprising:

a body having a front, a rear, opposite sides, a top, and a bottom;

said top including upper, middle, and lower stepped portions descending from said rear toward said front; and an elongated support member arranged transversely on said top between said upper stepped portion and said middle stepped portion, said elongated support member projecting above said upper stepped portion;

whereby said pillow is positionable under a supine person, so that a head thereof is supported by said upper stepped portion, a neck thereof is supported by said elongated support member, and a pair of shoulders thereof is supported by said middle and lower stepped portions; said pillow is also positionable under said person when said person is lying sideways, so that said head is supported by said elongated support member, and one of said shoulders is supported by said middle and lower stepped portions.

6. The pillow of claim 5 wherein said rear is substantially thicker than said front.

7. The pillow of claim 5 wherein said upper, middle, and lower stepped portions are sloped downwardly toward said front.

8. The pillow of claim 5 wherein a top of said elongated support member is spaced from a top of said lower stepped portion a distance generally equal to a width of one of said shoulders.

* * * * *